United States Patent [19]

Henges, Jr. et al.

[11] 4,196,555

[45] Apr. 8, 1980

[54] WALL STRUCTURE AND INTERLOCKING COMPONENTS THEREFOR

[75] Inventors: J. Gordon Henges, Jr., Frontenac; Carolyn S. Dean; Steve W. Schulte, both of St. Charles, all of Mo.

[73] Assignee: J Henges Enterprises, Inc., St. Louis County, Mo.

[21] Appl. No.: 909,788

[22] Filed: May 26, 1978

[51] Int. Cl.[2] ..... E04C 1/30

[52] U.S. Cl. ..... 52/588

[58] Field of Search ..... 52/588, 731, 395

[56] References Cited

U.S. PATENT DOCUMENTS

| | | | |
|---|---|---|---|
| 3,601,946 | 8/1971 | Rothemund | 52/588 X |
| 3,813,839 | 6/1974 | Simpson et al. | 52/588 |
| 3,952,461 | 4/1976 | Kinsey | 52/588 X |
| 4,099,358 | 7/1978 | Compaan | 52/588 |

FOREIGN PATENT DOCUMENTS

| | | | |
|---|---|---|---|
| 1013091 | 12/1965 | United Kingdom | 52/588 |

*Primary Examiner*—J. Karl Bell

*Attorney, Agent, or Firm*—Gravely, Lieder & Woodruff

[57] ABSTRACT

A wall structure is composed of interlocked components which are joined together by pivoting one component relative to the next until the two components snap into interlocking engagement. The components may take the form of wall panels, corner posts, wireways, or the like. In the case of wall panels, each has a side member that includes a web along the side edge of the panel and flanges projecting outwardly from the web. One flange on each web is a pivot flange and the pivot flange of the one side member has a rib, while the pivot flange on the connected side member has a groove which receives the rib. This enables the two side members as well as the wall panels of which they are part, to pivot relative to each other about an axis that is fixed with respect to those wall panels. One of the side members also has a retaining flange which projects outwardly from its web, while the other side member has a connecting flange which projects outwardly from its web. As the two side members are pivoted together, the retaining and connecting flanges snap into engagement and interlock, thereby securely coupling the two wall panels. The corner post has side walls provided with retaining and connecting sections and also a center web. The center web is provided with a pivot section having both a pivot rib and a groove which correspond to their counterparts on the two side members. The side walls have retaining and connecting sections that correspond in configuration to the retaining and connecting flanges on the side members. As a consequence, the side members of two wall panels may be pivoted into interlocking engagement with the corner post so that the wall sections are disposed at an angle with respect to each other. The wireway has corresponding pivot, retaining, and connecting flanges and may be coupled with the wall panels or corner post in a like manner.

23 Claims, 5 Drawing Figures

WALL STRUCTURE AND INTERLOCKING COMPONENTS THEREFOR

BACKGROUND OF THE INVENTION

This invention relates in general to wall structures and more particularly to wall structures composed of interlocking components which are joined together by pivoting one component relative to the component with which it is to be coupled.

Many small buildings such as in-plant offices and kiosks for parking lot attendants are constructed from prefabricated components which are shipped to the building site and there erected. Normally, it requires the services of a skilled carpenter to connect these components together, for the components must be precisely aligned and then joined to one another with suitable connecting devices, such as wood or metal screws. Even so, the foregoing procedure is considerably quicker and far more economical than conventional on-site construction procedures as currently used in the building industry.

The walls of the typical building under consideration usually consist of panels, most of which measure 4×8 feet. These have a peripheral frame formed from aluminum structural shapes and within this frame is a panel material often backed by a rigid foam-type insulation. Some of the panels may contain glazing while others may contain door frames.

The manner in which the panels are joined together varies from system to system. In some systems the side members of adjacent frames are butted together, aligned and clamped, and then bolts or some other connecting devices are run through them. Next cover plates are fitted and installed. This requires the services of a skilled carpenter. In other systems, the side of the frames are configured to receive connecting devices which resemble the cleats used in sheet metal work for joining duct sections. These connecting devices are not easy to install. Often due to normal manufacturing tolerances, the fits are tight and this becomes critical when extended for the full eight foot height of a panel. As a consequence, installation consumes considerable time.

SUMMARY OF THE INVENTION

One of the principal objects of the present invention is to provide a wall structure that may be erected at a building side in a minimum amount of time with unskilled labor. Another object is to provide a wall structure of the type stated having panels that snap together and interlock along their sides. A further object is to provide a wall structure of the type stated in which the connections between the panels enable one panel to pivot on the other panel so that the leverage afforded by the substantial width of the panels may be employed to effect the snap connection. An additional object is to provide a wall structure having corner posts and wireways that mate with and snap into engagement with the panels and each other. Still another object is to provide a wall structure of the type stated that is structurally sound and attractive in appearance. These and other objects and advantages will become apparent hereinafter.

The present invention is embodied in a wall structure comprising first and second wall components, each having pivot means that enable the components to pivot relative to each other and locking means which engage and interlock when the two components are brought, by virtue of the pivoting, to a predetermined position relative to each other. The invention also resides in side members having the pivot and locking means on them in the form of flanges, and in a corner post that has a pivot section and retaining and connecting sections capable of interlocking with the side members of the wall panels. The invention also consists in the parts and in the arrangements and combinations of parts hereinafter described and claimed.

DESCRIPTION OF THE DRAWINGS

In the accompanying drawings which form part of the specifications and wherein like numerals and letters refer to like parts wherever they occur

DETAILED DESCRIPTION

Figure 1:
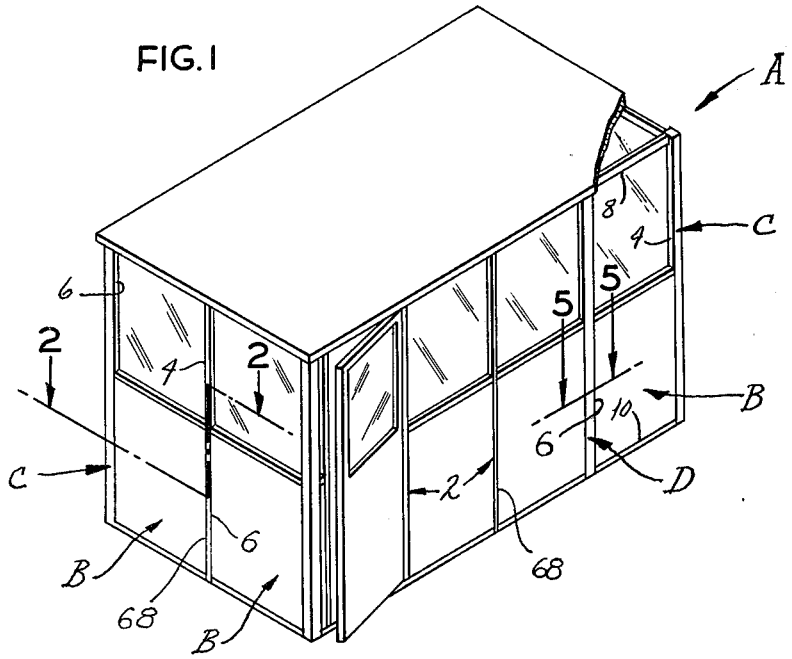
FIG. 1 is a perspective view of a small building having side walls constructed from wall components of the present invention.

Referring now to the drawings, A (FIG. 1) designates a prefabricated building, the walls of which are constructed from individual wall components which are joined together along their sides. The components may take the form of wall panels B, corner posts C, electrical ways D, or the like. The wall panels B constitute the major component of the wall system for the building A inasmuch as they occupy the most area. The corner posts C, of course, provide right angle transitions between adjacent panels B, while the wireways D house electrical wiring, receptacles, switches, and the like. No separate fasteners are necessary to connect the panels B to each other or to the corner posts C or electrical wireways D. Quite to the contrary, each panel B snaps onto the adjoining component of the system, whether it be another panel B, a corner post C, or a wireway D, and the snap connection is effected by pivoting that panel B relative to the adjoining component.

All the panels B will normally have the same height, but they need not necessarily have the same width. Even so most will be a standard size, such as 4×8 feet. While the peripheral configurations of the panels B are similar, except perhaps for variances in width, the several panels B serve different purposes and have different interior arrangements to accommodate those purposes. For example, some of the wall panels B may be solid, others may have a single pane of fixed glass, others may have panes of sliding glass, and still others may contain door frames and doors that open out of the frames.

Irrespective of its size or interior arrangement, each panel B includes (FIG. 1) a peripheral frame 2 of rectangular configuration which is composed of spaced apart side members 4 and 6 and spaced apart end members 8 and 10 with the latter being extended between the ends of the former. Preferably, the side members 4 and 6 and the end members 8 and 10 are aluminum extrusions.

While the end members 8 and 10 may have the same cross-sectional configuration, the side members 4 and 6 do not. On the contrary, the side member 4 is configured to fit into and interlock with the side member 6 of the adjacent panel B. In any event, the peripheral frame 2 surrounds and rigidifies an interior panel 12 which may be a conventional panel material or glass or a combination of the two, to name a few possibilities. Actually, the interior arrangement may take a wide variety of forms, but the particular form which is utilized is not too significant.

The side member 4 (FIGS. 2–4) of the frame 2 is an elongated unitary structure that extends the full length of the wall panel B and has a central web 20 that occupies the full depth of the member 4, that is, it extends from the front to the back of the member 4. "Front" in this regard refers to that portion of the member 4 which faces outwardly toward the exterior area surrounding the building, while "back" refers to that portion of the member 4 which is presented toward the interior of the building A. Moreover, the web 20 has an inside surface which is presented toward the edge of the interior panel 12 and an outside surface that is presented away from the interior panel 12. The inside surface is for the most part planar and unobstructed.

Joined to the back edge of the web 20 is an inwardly directed mounting flange 26 and an outwardly directed pivot flange 28, both of which have a common back face presented toward the interior of the building A. The mounting flange 26 serves as a mount for the interior panel 12 inasmuch as it extends over the back face of the panel 12 and retains that panel in place. The pivot flange 28 is substantially narrower than the mounting flange 26 and has a convex rib 32 (FIG. 3) located along its outer margin. The rib 32 projects forwardly, that is, toward the front end of the web 20, and is of semicircular or at least arcuate in cross section.

At the forward end of the web 20 the side member 4 has another mounting flange 33 that projects inwardly and a retaining flange 34 (FIG. 3) that projects outwardly. The two flanges 33 and 34 share a common front face that is exposed at the exterior of the building. The mounting flange 33 extends over the front face of the exterior panel 12 so that the panel 12 at its inside edge is captured between the two flanges 33 and 34. The remaining flange 34 has a groove 36 that opens rearwardly toward the pivot flange 28 and is arcuate in cross-section. In addition, the retaining flange 28 has a beveled camming surface 38 leading up to the groove 36.

On its outside face between the two flanges 28 and 34 the web 20 also has a rigidifying flange 40 (FIG. 3) that terminates in an abutment lip 42 which turns forwardly so as to be parallel to the web 20. It also has arcuate ridges 44 which not only further rigidify the web 20, but also form cavities into which sheet metal screws may be threaded from each end of the side member 4 for securing other components of the building A in place.

The other side member 6 is also preferably an aluminum extrusion and at first appearance seems quite similar to the side member 4, but it is actually not, for it is configured to mate and interlock with the side member 4 of another wall panel B. The side member 6 likewise includes (FIGS. 2–4) a central web 50 having an inside face that faces the side edge of the interior panel 12 and an outside face that is presented in the opposite direction. Along its back edge the web 50 is joined to an inwardly directed mounting flange 56 and an outwardly directed pivot flange 58 which share a common back face. The mounting flange 56 also overlies the back face of the interior panel 12. The pivot flange 58 has a rearwardly opening groove 60 (FIG. 3) of arcuate cross section, and that groove is configured to receive and conform with the convex rib 32 on the pivot flange of another wall panel B. The flange 58 extends outwardly beyond the groove 36, but this portion of the flange 56 is offset forwardly from the common front face of the two flanges 56 and 58 and is of lesser width than that space on the side member 4 which is located between the convex rib 32 and the central web 20.

Along the forward edge of its web 50, the side member 6 has an inwardly directed mounting flange 61 and an outwardly directed connecting flange 62 joined to it. The mounting flange 61 overlies the front face of the interior panel 12 so that the panel 12 is captured between the two mounting flanges 56 and 61. The connecting flange 62 has an intermediate edge 63 (FIG. 3) where it merges into a locking lip 64 that is offset slightly rearwardly from the flange 62. The locking lip 64, in turn, has a convex locking bead 66 along its outer margin, and that bead is configured to fit into the groove 36 in the retaining flange 36 of the side member 4 on another wall panel B. The offset of the locking lip 64 is such that when the bead 66 is received in the groove 36 of the retaining flange 34 on the side member 4 of the outer wall panel B (FIG. 2), the front faces of the two flanges 62 and 34 will be flush and the outer end of the beveled surface 38 on the flange 34 will be adjacent to the intermediate edge 63 of the connecting flange 62. Moreover, the spacing between the groove 60 and the locking bead 66 on the side member 6 is slightly less than the spacing between the convex rib 32 and the groove 36 on the side member 4, but is greater than the distance between the convex groove 32 and the inner margin of the beveled surface 38. This spacing enables the side member 6 to interlock with the side member 4 on the outer wall panel B to produce a mullion 68 between the adjacent panels B. When so interlocked, the groove 60 in the pivot flange 58 of the member 6 receives the rib 32 on the pivot flange 28 of the member 4, and at the front of the mullion 68, the locking bead 60 on the locking lip 64 of the side member 6 fits into the groove 36 in the retaining flange 34 of the member 4.

Figure 2:
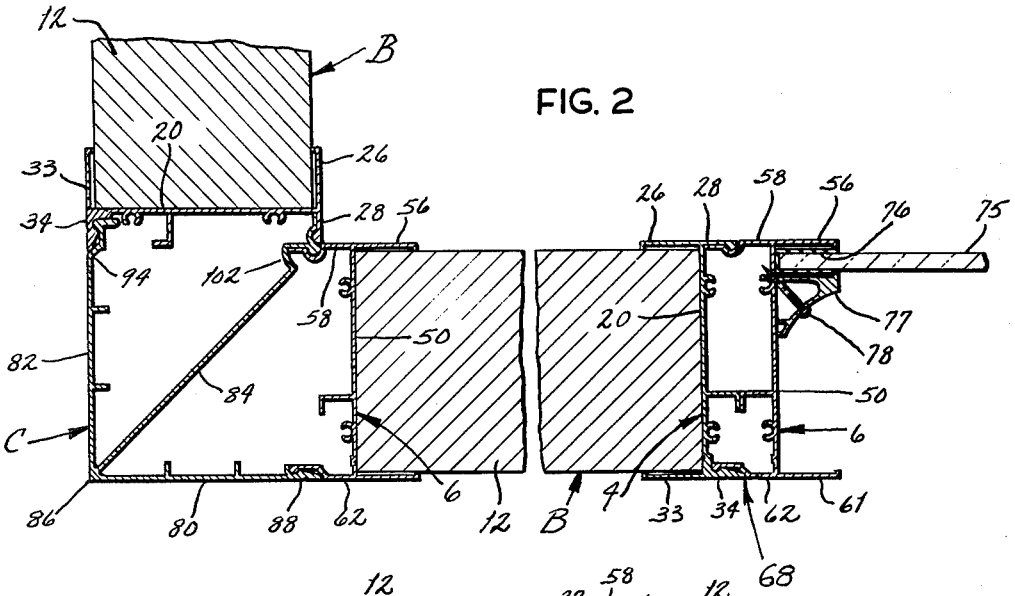
FIG. 2 is a sectional view taken along lines 2—2 of FIG. 1 and showing interlocking side members and a corner post.
Figure 3:
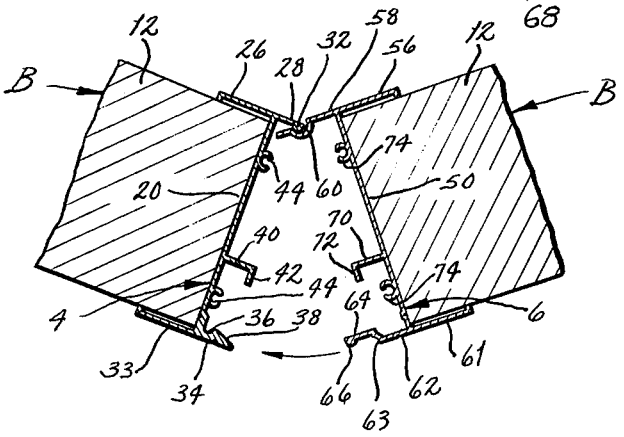
FIG. 3 is a sectional view showing the side member of one wall panel pivoted on the side member of another wall panel to join the two wall panels together.

The side member 6 further has a rigidifying flange 70 (FIG. 3) that projects outwardly from its outside face and terminates at an abutment lip 72 that is parallel to the web 50. This lip 72 is positioned such that it will abut against the abutment lip 42 on the side member 4 of the adjacent panel B when the side members 6 and 4 are interlocked (FIG. 2). Also, the side member 6 has arcuate ridges 74 into which metal screws may be threaded from the ends of the member 6.

While the interior panel 12 for each wall panel B occupies the full space between the two mounting flanges 26 and 33 on the side members 4 and the full space between the mounting flanges 56 and 61 on the side member 6, glazing and some other wall materials are not so wide. They are mounted against the back mounting flanges 26 and 56. For example a pane of glass 75 (FIG. 2) has its edge fitted into an elastomeric seal 76 that extends along the flanges 26 and 56. The panel 75 is prevented from falling forwardly by a cove 77 that is fastened to the webs 20 and 50 by sheet metal screws 78.

To couple adjacent wall panels B (FIG. 3), which is necessary in order to erect the building A, the panel B is held in an upright position with its side member 4 completely accessible. The other wall panel B is then brought into general alignment with first wall panel B so that the side member 6 on the second wall panel B is located next to the side member 4 of the first wall panel B. However, the two wall panels B do not at this time form straight line continuation of each other, but instead the second panel B is cocked back slightly from the first so that the included angle between the back faces of the two panels B, that is, the angle at the interior of the building, is slightly less than 180°. With the wall panels B so positioned, the second panel B is maneuvered such that the pivot flange 58 on its side member 6 is brought over the pivot flange 28 of the side member 4 for the first panel B until the convex rib 32 on the latter fits into the groove 60 on the former. Then, using the convex rib 32 of the side member 4 as a fulcrum or pivot, the second panel B is swung forwardly with respect to the first so as to approach a condition of straight alignment. As the second panel B swings forwardly, the connecting flange 62 on its side member 6 approaches the retaining flange 34 on the side member 4 of the first panel B. However, before the flanges 62 and 34 are completely together, the convex bead 66 of the locking lip 64 that is positioned on connecting flange 62 comes against the beveled camming surface 38 of the returning flange 34. The beveled surface 38 cams the bead 66 inwardly and in so doing deflects the locking lip 64 and connecting flange 62 inwardly also, but not beyond the elastic limit of the metal from which the side member 6 is formed. Once the bead 66 reaches the back edge of the beveled camming surface 38, it snaps into the groove 36 located beyond the camming surface 38 in the retaining flange 34, thus locking the two panels B together in perfect alignment (FIG. 2). When the two panels B are so disposed, the abutment lip 42 on the side member 4 for the first panel B abuts against the abutment lip for the side member 6 for the second panel B. This prevents the relatively deep webs 20 and 50 from being deflected inwardly toward each other. Also the back faces of the mounting flanges 26 and 56 on the two side members 4 and 6 are flush, and the same holds true for the front faces of the adjoining retaining flange 34 and connecting flange 62.

Of course, the second panel B could be held stationary and the first panel B could be pivoted relative to it to join the two panels B together. In that case the convex rib 32 on the pivot flange 28 of the side member 4 for the first panel B would be maneuvered into the groove 60 in the pivot flange 58 of the side member 6 for the second panel B. As the first panel B is swung into a position of alignment the retaining flange 34 on its side member 4 would move over the locking lip 64 on the connecting flange 62 of the side member 6 and deflect the lip 64 and flange 62 inwardly until the bead 66 on the lip 64 snaps into the groove 36 in the retaining flange 34.

Thus, the two panels B are joined together at their side members 4 and 6 merely by pivoting the one panel B relative to the other panel B about a well defined pivot axis which, owing to the reception of the convex rib 32 for the side member 4 in the groove 36 for the side member 6, is fixed and determined with respect to the two panels B and is not easily displaced. While the two panels B snap into engagement with each other, an excessive amount of force is not required to effect the snap engagement, notwithstanding the substantial length of the side members 4 and 6 along the full length of which the snap lock exists. This derives from the fact that the panels B are pivoted relative to each other, enabling a substantial mechanical advantage to be acquired. Hence, relatively little force applied to the second panel B is all that is necessary to deflect the locking lip 64 and connecting flange 58 of the side member 6, even along the full length of that member. In other words, the second panel B serves as a large lever arm for providing the force that is necessary to deflect the lip 64 and connecting flange 58.

Other panels B may be joined to the first and second panels B, previously described, in a like manner to form a wall structure. The wall structure so formed need not necessarily be that of a building, but may be used merely for partition purposes, such as in offices.

When used in the building A, the mullions 68 formed by the interlocked side members 4 and 6 of panel B are further rigidified by other components of the building A such as the roof and floor. Even so still more rigidity may be obtained by passing bolts through the webs 20 and 50 of the two side members 4 and 6. The rigidifying flanges 40 and 70 and the abutment lips 42 and 72 on them prevent the webs 20 and 50 from deforming inwardly when such bolts are tightened down.

Whereas the panels B, when joined directly to each other at their mating side members 4 and 6 are disposed at 180° with respect to each other, the corner post C when interposed between the side member 4 of one wall panel B and the side member 6 of the adjacent panel B enables those panels B to be connected at a right angle to each other (FIG. 2). To this end, the side member 4 of the one panel B interlocks with the corner post C along one of its four sides, while the side member 6 of the other panel B interlocks with the corner post C along another of its sides. The connections between the corner post C and the side members 4 and 6 of the two panels B are snap-type connections that are substantially the same as the connections between the two side members 4 and 6 and are produced in substantially the same manner.

The corner post C, like the side members 4 and 6, is formed from a metal such as aluminum preferably in an extruding process, so that the corner post C is a unitary structure. The corner post C includes (FIG. 4) side walls 80 and 82 and a center web 84, all of which radiate from a corner 86, with the walls 80 and 82 being arranged at 90° with respect to each other and the center web 84 bisecting the right angle formed by the two walls. Moreover the center web 84 extends outwardly a sufficient distance to form a generally four-sided configuration. Two sides of the configuration are occupied by the walls 80 and 82 and are therefore closed. The other two sides are open.

The side wall 80 at its free end has a retaining section 88 which in cross section is indentical to the retaining flange 34 on the side member 4. As such, it includes a groove 90 of arcuate cross section and a beveled camming surface 92 leading up to the groove 90. The retaining section 88 is formed integral with the remainder of the side wall 80 as a straight continuation of that sidewall, and is configured to interlock with the connecting flange 6 of a side member 6.

The other side wall 82 at its free end possesses a connecting section 94 which in cross section is very similar to the connecting flange 62 on the side member 6. However, the connecting section 94, aside from being integral with the side wall 82, forms a straight continuation of the side wall 82. Being similar in configuration to the connecting flange 62, the connecting section 94 includes a locking lip 96, which is offset rearwardly with respect to the remainder of the wall 82, and a convex locking bead 98 which projects forwardly. In addition, the connecting section 94 has a reinforcing flange 100 that projects rearwardly from the bead 98 at a right angle to the lip 96 and wall 82. The connecting section 94 is configured to interlock with the retaining flange 34 on a side member 4.

The center web 84, as previously noted, extends far enough outwardly to impart a four-sided configuration to the corner post C, and the web 84 at its free end is provided with a pivot section 102 that is formed integral with it and enables both a side section 4 and a side section 6 to pivot on the corner post C and interlock respectively with the connecting section 94 of the wall 82 and the retaining section 88 of the wall 80. More specifically, the pivot section 102 includes an offset 104 which is projected toward the connecting section on the wall 94 and has a groove 106 that opens generally toward the retaining section 88 on the side wall 82. Along the outer edge of the groove 106 is a pivot rib 108 which is very similar to the rib 32 on the pivot flange 28 of the side member 4. The rib 108 conforms to the groove 60 in the pivot flange 58 of a side member 6, while the groove 106 is wide enought to accommodate that portion of the pivot flange 58 located beyond the groove 60. The spacing between the rib 108 of the pivot section 102 and the retaining section 88 of the side wall 80 is such that a side member 6 of a panel B will interlock with the post C at its retaining and pivot sections 88 and 102.

Figure 4:
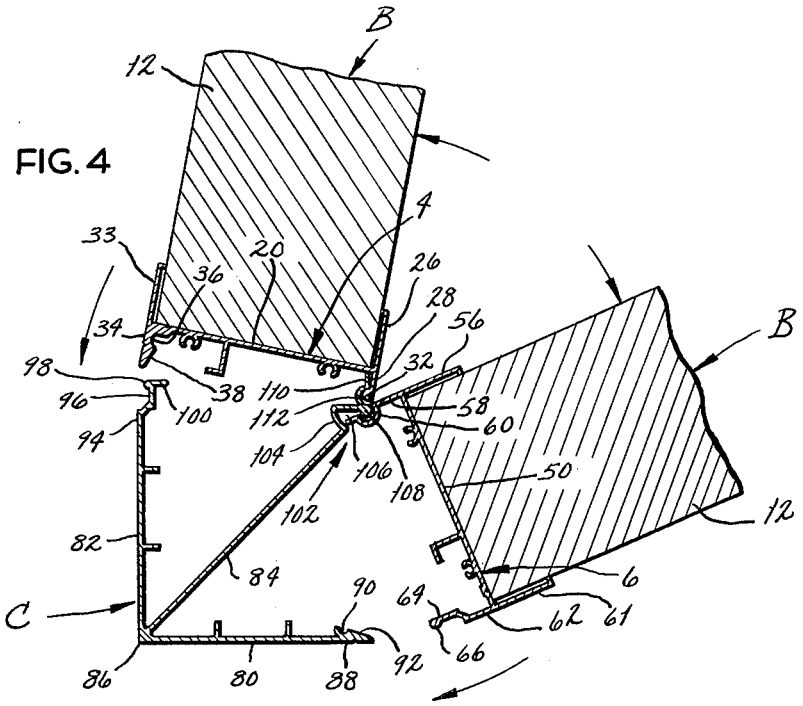
FIG. 4 is a sectional view of a corner post showing two wall panels pivoted on it to join those wall panels to the corner post.

To connect a panel B along its side member 6 with the corner post C, the pivot flange 58 of the side member 6 is placed over the pivot rib 108 such that the rib 108 is received in the groove 60, but the connecting flange 62 on the member 6 is spaced from the retaining section 88 on the side wall 80 of the post C (FIG. 4). Then the entire panel B is rotated on the pivot rib 108 until the locking bead 66 engages the camming surface 92 on the retaining section 88 of the side wall 82. Continued movement flexes the side wall 80 outwardly and the locking lip 64 of the side member 6 inwardly, all of which enables the locking bead 66 of the side member 6 to pass across the beveled surface 92 of the retaining section 88 of the side wall 80 on the post C until the bead 66 snaps into the groove 90 of the retaining section 88, thus interlocking the side member 6 and corner post C (FIG. 2). When so interlocked, the front face of the side wall 80 on the corner post C is flush with the front face on the connecting flange 62 of the side member 6.

In addition, to the offset 104 and the pivot rib 108, the pivot section 102 for the corner post C further includes a lip 110 which projects laterally generally parallel to the side wall 82, and that lip contains a groove 112 that is located adjacent the pivot rib 108. This groove 112 is arcuate in cross section and conforms to the pivot rib 32 on a side member 4. The spacing between the lip 110 and the connecting section 94 of the corner post C is such that the side member 4 for a wall panel B will interlock with the corner post C and its connecting and pivot sections 94 and 102.

To connect a panel B to the corner post C along the side member 4 of the panel B, the pivot rib 32 on the pivot flange 28 of the side member 4 is fitted into the groove 112 in the lip 110 of the pivot section 102 for the post C, while the retaining flange 34 on the side member 4 and the connecting section 94 on the side wall 82 of the corner post C are spaced slightly apart (FIG. 4). Then the entire panel B is pivoted about the rib 32 within the groove 112 until the beveled surface 38 on the retaining flange 26 for the side member 4 comes against the locking bead 98 on the connecting section 94 for the corner post C. With continued movement, the locking bead 98 will pass across the beveled surface 38 and deflect the side wall 82 inwardly until the bead 98 reaches the groove 36 in the retaining flange 34, at which time it will snap outwardly into the groove 36 (FIG. 2). This interlocks the corner post C and side member 4, and when so interlocked, the front face of the retaining flange 34 on the side member 4 is flush with the front face of the side wall 82.

Thus, two wall panels B are interlocked with the corner post C with one being engaged with the corner post C along its side member 6 and the other along its side member 4. When the panels B and the corner post C are so interlocked, the panels B are positioned at 90° with respect to each other, and the webs 20 and 50 of the side members 4 and 6 complete and close the four-sided configuration of the corner posts C.

Figure 5:
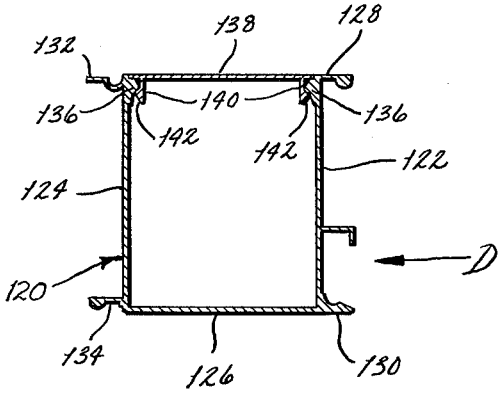
FIG. 5 is a sectional view taken along line 5—5 of FIG. 1 and showing a wireway, but with the adjacent wall panels omitted.

The wireway D includes (FIG. 5) a channel 120 having side walls 122 and 124 and a front wall 126 that interconnects the side walls 122 and 124 along their front margins, and is positioned at right angles with respect to them. Along its rear margin the side wall 122 has pivot flange 128 that is identical to the pivot flange 28 of a side member 4, while along its front margin it has a retaining flange 130 that is identical to the retaining flange 34 on the side member 4. Similarly the side wall 124 along its rear margin has pivot flange 132 and along its front margin has a connecting flange 134. The two flanges 132 and 134 are identical to the flanges 58 and 62 of a side member 6. Thus, the side wall 122 with its flanges 128 and 130 corresponds closely to a side member 4, while the side wall 124 with its flanges 132 and 134 corresponds closely to a side member 6. In effect, the wireway D is a dimutive wall panel that along its side wall 122 interlocks with the side member 6 on a wall panel B and along its side wall 124 interlocks with the side member 4 of another wall panel B.

The channel 120 along the inside faces of its side walls 122 and 124 is provided with inwardly directed ribs 136 which are located immediately in front of the rear margins for those walls. The ribs 136 secure a cap 138 over the open rear end of the channel 120. The cap 138 spans the space between the two side walls 122 and 124 and includes forwardly directed legs 140 having outwardly directed lips 142 which are spaced slightly further apart than the ribs 136 on the legs 122 and 124.

To install the cap 138, its legs 140 are aligned with the inside surface of the ribs 136 on the sidewalls 122 and 124. Then the cap 138 is driven forwardly with sufficient force to deflect the legs 140 inwardly toward each other and perhaps the side walls 122 and 124 outwardly. In any event, when the cap 128 is fully seated, the lips 142 on its legs 140 project beyond the lips 136 on the side walls 122 and 124.

Both the channel 120 and the cap 138 are preferably aluminum extrusions. The channel 120 functions as a conduit for electrical wiring, while the cap 138 not only closes the channel 120, but also serves as a mounting for electrical switches, receptacles and the like.

This invention is intended to cover all changes and modifications of the example of the invention herein chosen for purposes of the disclosure which do not constitute departures from the spirit and scope of the invention.

What is claimed is:

1. An improved vertical wall structure suitable for use in a building as an exterior wall, and interior wall, a partition wall, or some other vertical wall, said wall structure comprising: a first wall panel having a first side member along one of its sides and a second wall panel having a second side member along one of its sides, with the first side member of the first wall panel being located adjacent to and along the second side member of the second wall panel, each of the side members having a web that extends generally front to rear with respect to its wall panel with the web having front and rear margins, so that the webs of the two side members are located opposite to and face each other, each of the side members also having a pivot section mounted on its web along one margin for the web, the pivot section for the first side member having a groove and the pivot section for the second side member having a rib that fits snugly in the groove, with the groove and rib being configured such that the panels can pivot with respect to each other about an axis that is fixed in position with respect to the two panels, each of the side members further having locking means mounted on its web along the other margin of the web for engaging the locking means of the other side member and thereby preventing the wall panels from pivoting, the locking means of the two side members being positioned on their respective webs such that they align and move into locking engagement when the panels are pivoted about the fixed axis to a predetermined position, one of the locking means including a locking bead of convex configuration and the other of the locking means containing a locking groove that receives the bead when the panels are in the predetermined position.

2. The structure according to claim 1 wherein the groove and rib of the pivot sections are of matching arcuate cross-sectional configuration.

3. The structure according to claim 1 wherein at least one of the side members is formed from a material that has a limited amount of resiliency and wherein the locking means that contains the locking groove also has a beveled surface leading up to the groove, with that surface being configured to engage the bead as the two side members are pivoted relative to each other toward the predetermined position, and to further deflect the bead relative to the groove to enable the bead to pass across the beveled surface and enter the locking groove.

4. The structure according to claim 1 wherein the first wall panel has a second side member along its other side edge and the second wall panel has a first side member along its other side edge.

5. The structure according to claim 1 wherein the pivot section for the first side member is a pivot flange projected from the web of that side member toward the second side member, and the pivot section for the second side member is a pivot flange projected from the web of that side member toward the first side member.

6. The structure according to claim 5 wherein the locking means on the first side member includes a locking flange which projects from the web of that side member toward the second side member, and the locking means on the second side member is a locking flange which projects from the web of that side member toward the first side member, the locking flange of each side member being generally parallel to the pivot flange for that side member.

7. The structure according to claim 6 wherein each wall panel further includes an interior panel member having a side edge located along the web of the side member for that wall panel; and wherein each side member has a mounting flange that projects from the web away from the pivot flange for that side member and overlies the face of the interior panel member, obscuring the side edge of the panel member.

8. The structure according to claim 7 wherein the mounting flange for the side member of each wall panel is flush with the pivot flange for that side member.

9. The structure according to claim 7 wherein each side member further includes another mounting flange that projects from the web away from the locking flange for that side member, the two mounting flanges being spaced apart and receiving the edge of the interior panel member between them.

10. The structure according to claim 6 wherein the locking flange of the second side member has the locking groove, and the locking groove opens toward the arcuate rib on that side member; wherein the locking flange of the first side member has the locking bead which projects away from the pivot flange for that side member; and wherein the pivot and locking flanges for the first side member fit in part between pivot and locking flanges for the second side member.

11. A corner post for connecting two wall panels that are capable of being connected to each along their side edges such that the one wall panel lies generally in the same plane as the other wall panel, the one wall panel having pivot groove along its side edge while the other has a pivot rib along its side edge, with the groove being configured to receive the rib so as to enable the panels to pivot relative to each other, each wall panel further having locking means along its side edges, with the locking means of the two panels being adapted to engage each other and hold the panels in same plane when they are pivoted to that position, said corner post being adapted to connect the panels at an angle and comprising: first and second walls that are joined together at a predetermined angle, locking means on each of the walls, the locking means on the first wall being capable of engaging the locking means on said one wall panel and the locking means on the second wall being capable of engaging the locking means on said other wall panel; and a center web interposed between the first and second walls having fixed and free edges, the center web being secured at its fixed edge in a fixed and determined position with respect to the two side walls, the center web along its free edge having a rib that is configured to fit into the groove of said one wall panel, enabling that wall panel to pivot with respect to the corner post such that the locking means on said one panel comes into engagement with the locking means on the first wall of the corner post, the center web along its free edge also having a groove that is configured to receive the rib on the other wall panel, enabling that other wall panel to pivot with respect to the corner post such that the locking means on the second wall of the corner post comes into engagement with the locking means on said other wall panel.

12. A corner post according to claim 11 wherein the first and second walls are joined to each other at a corner and the web is joined to the first and second walls at the corner.

13. A corner post according to claim 12 wherein the center web generally bisects the angle formed by the first and second walls of the corner post.

14. A corner post according to claim 11 wherein the first and second walls are generally planar and are joined to each other at a right angle corner; and wherein the fixed edge of the web is secured to the first and second walls at the right angle corner.

15. A corner post according to claim 11 wherein the rib on the center web projects toward the locking means on the first wall and the groove on the center web opens away from the locking means on the second wall.

16. A corner post according to claim 15 wherein the center web in the region of its free edge has an offset which creates a groove adjacent to the rib of the center web, with the groove being capable of accommodating that portion of said one wall panel that contains the groove as said one wall panel pivots on the rib.

17. An improved vertical wall structure suitable for use in a building as an exterior wall, an interior wall, a partition wall, or some other vertical wall, said wall structure comprising: a first wall panel having a first side member along one of its sides and a second wall panel having a second side member along one of its sides, with the first side member of the first wall panel being located adjacent to and along the second side member of the second wall panel, each of the side members having a web that extends generally front to rear with respect to its wall panel with the web having front and rear margins, so that the webs of the two side members are located opposite to and face each other, each side member also having a pivot flange mounted on its web along one margin for the web, the pivot flange for the first side member having a groove and the pivot flange for the second side member having a rib that fits in the groove with the groove and rib being such that the two panels can pivot with respect to each other about a vertical axis, each side member further having a locking flange mounted on its web along the other margin of the web for engaging the locking means of the other side member and thereby preventing the wall panels from pivoting, the locking flanges being positioned on their respective webs such that they align and move into locking engagement when the panels are pivoted to a predetermined position, each side member in addition having a pair of mounting flanges attached to its web and projecting away from the web generally at the locations of the pivot and locking flanges thereon, the mounting flanges being generally parallel to each other; each wall panel further including an interior panel that along its side edge fits between the mounting flanges for the side member of that wall panel.

18. The structure according to claim 17 wherein mounting flanges for each side member are along their outwardly presented surfaces flush with the outwardly presented surfaces of the pivot and locking flanges for the side member.

19. The structure according to claim 17 wherein each side member is an extrusion in which the locking, pivot and mounting flanges are formed integral with the web.

20. The structure according to claim 17 wherein the locking flange on the one side member contains a locking groove and the locking flange on the other side member has a bead which is received in the locking groove when the two components are secured together in the predetermined position.

21. The structure according to claim 20 wherein the locking flange that contains the groove has a beveled camming surface leading up to the groove in the flange for deflecting the bead inwardly as the two wall panels are pivoted to the predetermined position.

22. The structure according to claim 17 wherein the groove in the pivot flange is of arcuate cross-sectional shape.

23. The structure according to claim 17 wherein the locking flange on the second side member has a groove that opens toward the pivot flange of that side member and a beveled camming surface leading up to the groove, and the pivot rib on the pivot flange projects toward the locking flange.

* * * * *

UNITED STATES PATENT AND TRADEMARK OFFICE

CERTIFICATE OF CORRECTION

PATENT NO. : 4,196,555

DATED : April 8, 1980

INVENTOR(S) : J. Gordon Henges, Jr., et al

It is certified that error appears in the above-identified patent and that said Letters Patent are hereby corrected as shown below:

Col. 9, line 2: After the word "wall" (first occurrence) and before the word "interior", the word "and" should be changed to read "an".

Col. 10, line 44: After the word "walls" and before the word "having", insert the word "and".

Signed and Sealed this

*Twenty-second* Day of *July 1980*

[SEAL]

*Attest:*

SIDNEY A. DIAMOND

*Attesting Officer*

*Commissioner of Patents and Trademarks*